United States Patent [19]

Krowatchek et al.

[11] Patent Number: 4,848,254

[45] Date of Patent: Jul. 18, 1989

[54] SEWING MACHINE WITH MULTIDIRECTIONAL UPPER AND LOWER FEED DEVICES

[75] Inventors: Fritz Krowatchek, Aachen; Horst Zinnsmeister, Kaiserslautern, both of Fed. Rep. of Germany

[73] Assignee: Pfaff Industriemaschinen GmbH, Fed. Rep. of Germany

[21] Appl. No.: 97,593

[22] Filed: Sep. 15, 1987

[30] Foreign Application Priority Data

Sep. 26, 1986 [DE] Fed. Rep. of Germany ..... 3632757

[51] Int. Cl.[4] ..... D05B 27/06; D05B 27/08; D05B 27/16

[52] U.S. Cl. ..... 112/313; 112/308; 112/320; 112/322

[58] Field of Search ..... 112/313, 314, 320, 322, 112/308

[56] References Cited

U.S. PATENT DOCUMENTS

| | | | |
|---|---|---|---|
| 3,055,325 | 9/1962 | Adler | 112/308 X |
| 3,980,032 | 9/1976 | Kleinschmidt et al. | 112/313 |
| 4,226,199 | 10/1980 | Adams | 112/308 |
| 4,509,443 | 4/1985 | Martell et al. | 112/113 X |
| 4,682,533 | 7/1987 | Bachmann et al. | 112/313 |

*Primary Examiner*—Andrew M. Falik
*Attorney, Agent, or Firm*—McGlew & Tuttle

[57] ABSTRACT

A sewing machine is provided with a upper and a lower feed device with which a workpiece consisting of several plies can, when making arched and/or corner type seams, be transported in always constant position of orientation without mutual displacement of the plies. For this purpose the feed direction of both feed devices can be varied either by changing their direction of action or by geometric addition of at least two motion components.

6 Claims, 5 Drawing Sheets

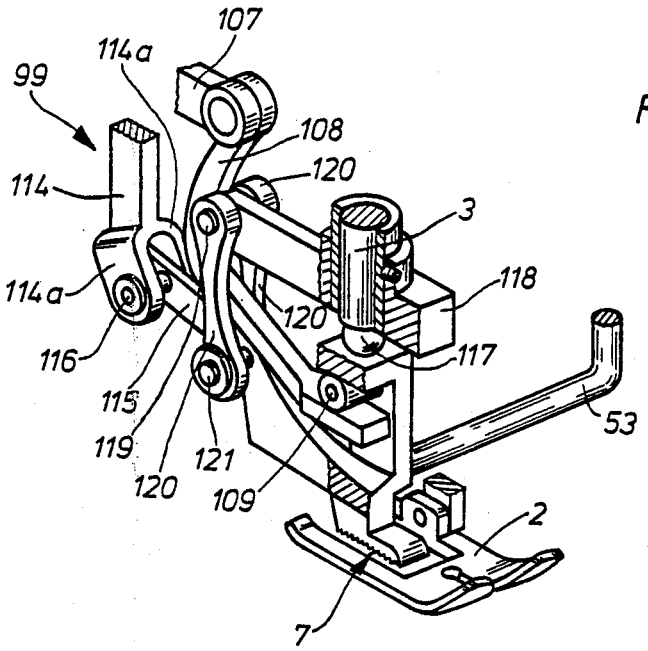
Fig.4
Fig 5
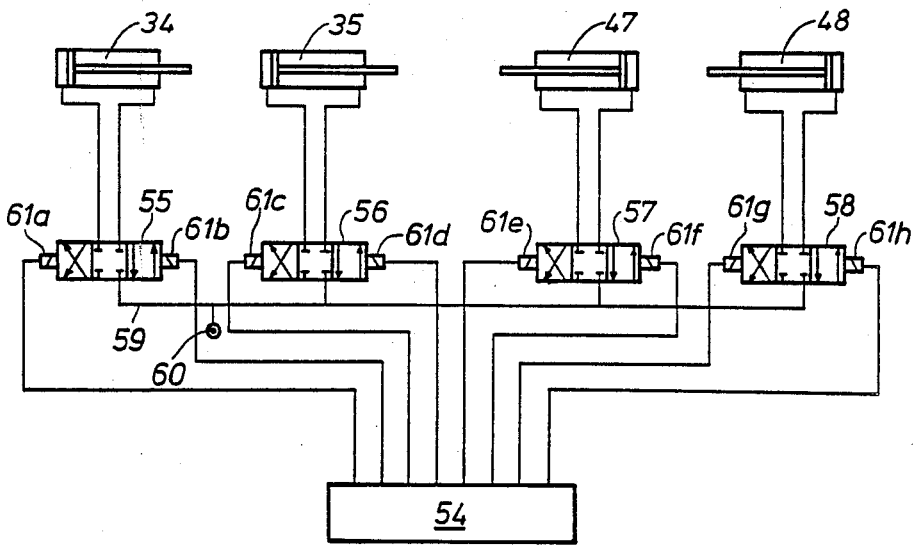

SEWING MACHINE WITH MULTIDIRECTIONAL UPPER AND LOWER FEED DEVICES

BACKGROUND OF THE INVENTION

From U.S. Pat. No. 3,808,995 a sewing machine is known having a lower feed dog and an upper feed dog which carry out a transport movement in a feed direction. The transport movement is adjustable separately for the lower feed dog and for the upper feed dog. By the combination of a lower feed dog with an upper feed dog a multiple-ply workpiece can be moved without displacing the individual plies relative to each other in an undesired manner. A desired relative motion, on the other hand, can be carried out.

If arched or corner type seams are to be made with the known sewing machine, it is necessary, because of the feed direction of the feed dog and upper feed dog is invariable as to angle, to turn the workpiece accordingly. This requires reducing the sewing speed or interrupting the sewing operation, whereby the production times and hence the costs per workpiece are increased. This is true in particular for large-area workpieces, as they are especially cumbersome to handle.

From U.S. Pat. No. 3,055,325, a sewing machine is known which comprises a lower feed dog acting in normal feed direction as well as in transverse feed direction. To initiate the movement in transverse feed direction, the movement taken off from a lower machine shaft is transmitted via an eccentric drive to an oscillating shaft and from the latter via a gear arrangement to a feed dog holder on which the feed dog is mounted. The amplitude of oscillation of the oscillating shaft can be changed either by a stitch setter or, to obtain a given seam pattern, by a cam.

With the arrangement according to U.S. Pat. No. 3,055,325, it is possible to obtain an overstitch enlarged in relation to the sideways swinging movement of the needle. Further it is possible to move the work either exclusively in the feed direction or exclusively in the transverse feed direction, in which case the respective stitch setter must be brought into the zero position. If both stitch setters adjustable by a common handle occupy a position differing from their zero position, the work can be transported in any desired direction.

In sewing machines of the above-described kind with a lower feed dog the disadvantage appears that plies of a workpiece which are to be sewn in equal lengths execute an undesired relative motion due to the difference in the speeds between the lower ply, moved by the feed dog, and the upper ply, frictionally taken along by the latter but decelerated by the braking action of a presser foot. This disadvantage, known in the sewing practice, is felt more strongly with a sewing machine which transports in any direction (i.e. including directions which deviate angularly from the longitudinal direction in the feed plain, because the error caused thereby now occurs not only along a line but the error is noticeable over the entire surface of this ply in accordance with the seam course.

SUMMARY AND OBJECT OF THE INVENTION

It is the object of the invention to create a sewing machine with which a workpiece consisting of several plies can, when making arched and/or corner type seams, be transported without mutual displacement of the plies, in always the same orientation.

According to the invention, a workpiece is movable in any direction. This type of transport is advantageous especially for large-area workpieces, in the conduction of which problems may arise when the formation of arched or corner type seams requires a combined sliding and swiveling movement of the workpiece. Since the lower as well as the upper feed device are movable in this advantageous manner, the individual plies of a multiple-ply workpiece are movable in any desired directions in such a way that the upper and lower plies are displaced depending on the setting of the different stitch setters synchronously with one another or so as to execute a desired adjustable relative motion, allowing, for example, extra width to be worked into one of the plies.

In an advantageous development according to the invention, the direction as well as the magnitude of the transverse feed movement to be executed are adjustable by a setting device. The direction is determined by the position of the feed dog and upper feed dog relative to the zero position in transverse feed direction, while the magnitude is determined by their amplitude of oscillation relative to the zero position.

A further object of the invention is to provide a sewing machine arrangement wherein several setting devices engage at a transverse feed mechanism by the arrangement according to the invention, there is no need for a mechanical gear connection between a feed dog and a part of the transverse feed mechanism moving the upper feed dog. Accordingly, the transverse feed mechanism can be designed more compactly and hence can be accommodated better in the housing of the sewing machine. Also, the drive gear control of the setting devices with different instructions for generating a differential transverse feed movement is facilitated by such an arrangement.

Still another object of the invention is to provide a sewing machine wherein the setting device is movable into the required position by at least one setting means. To this end the setting means may be formed as an electric motor, as a pneumatic or hydraulic cylinder, or as pitman drives. The control signals to the setting means originate from an electronic, hydraulic or pneumatic switching system or from a mechanical control cam actuated via a control unit or by the operator.

The independent controllability of the individual setting means facilitates the measures for moving the individual parts of the feed system synchronously or asynchronously with one another.

An additional object of the invention provides for a relatively compact and low-mass setting device, so that it can be installed in sewing machines where the space for receiving additional parts in the housing is very limited. Preferably the setting device includes cylinders which act as the setting means. As the cylinders have little inertia due to their small movable masses, the time required for adjusting the setting device is short.

According to the invention, the piston of each cylinder can occupy two uniquely defined limited positions, in that it is introduced into the interior of the cylinder or it is almost extracted therefrom. If the limit positions of the pistons are associated with well defined positions of the feed dog, or respectively of the upper feed dog, as for example their left and right reversal points as well as their zero position, they can be positioned at these points always with great precision, using extremely simple technical means. After appropriate control of the cylinders, the feed dog and upper feed dog can also be stopped between the above-mentioned well-defined positions, as the pistons can be moved in and out in continuous motion and can be stopped at any point of their stroke by the control unit.

The various features of novelty which characterize the invention are pointed out with particularly in the claims annexed to and forming a part of this disclosure. For a better understanding of the invention, its operating advantages and specific objects attained by it uses, reference is made to the accompanying drawings and descriptive matter in which a preferred embodiment of the invention is illustrated.

BRIEF DESCRIPTION OF THE DRAWINGS

In the Drawings:

FIG. 4 is a perspective view of the upper feed dog of the embodiment of FIG. 1, partly in section;

FIG. 5 is a simplified circuit diagram for the control of setting means of the transverse feed mechanism shown in FIGS. 1, 2 and 3;

DESCRIPTION OF THE PREFERRED EMBODIMENT

Figure 1:
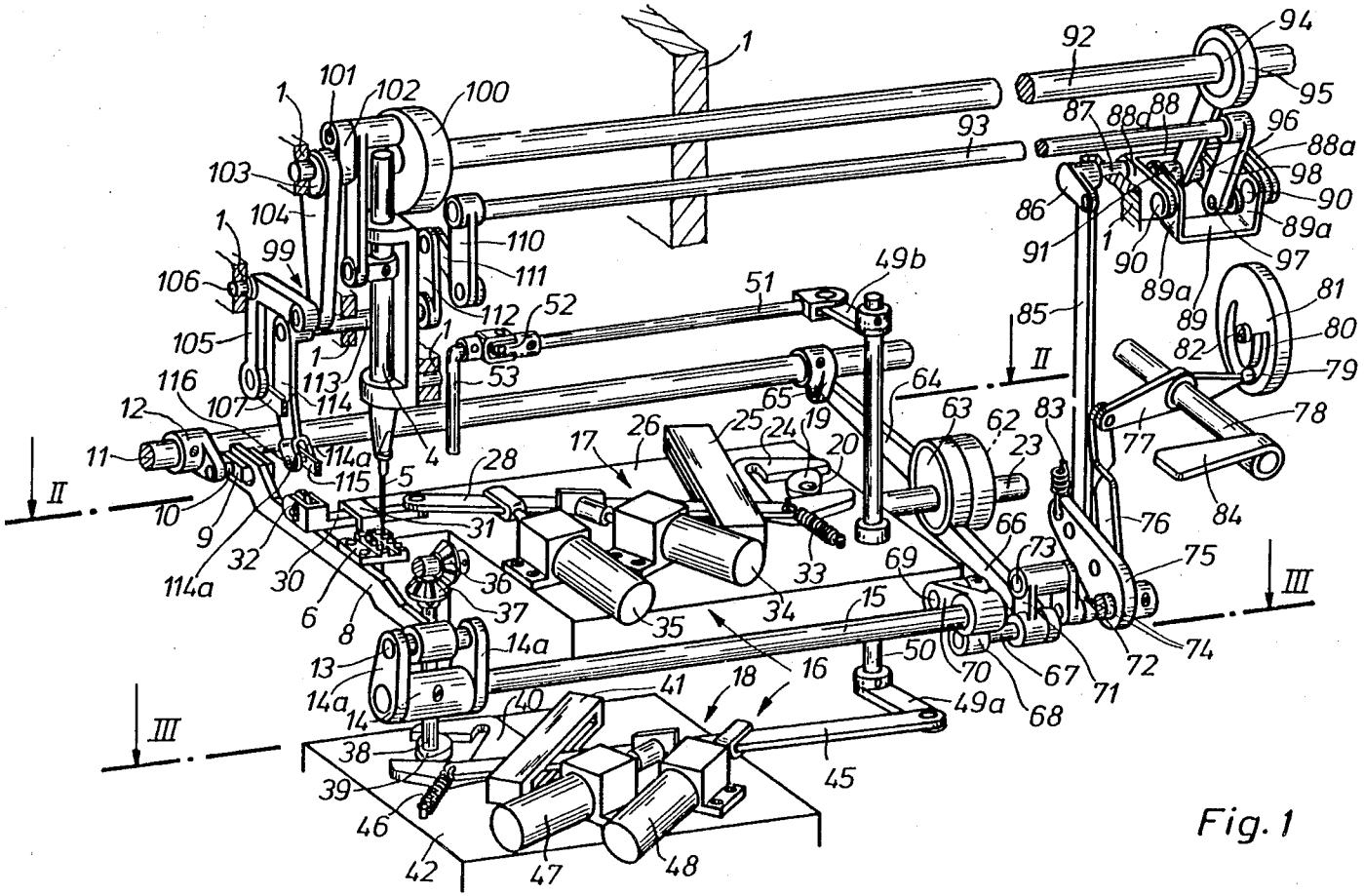
FIG. 1 shows a perspective view of the adjusting and drive parts for the feed dog and upper feed dog of a sewing machine in forward and transverse feed direction according to an embodiment of the invention.

According to a first embodiment of the invention, there are received in the head of a housing 1 of a sewing machine indicated in FIG. 1 a presser foot 2 (FIG. 4) and the needle bar 4 (FIG. 1) which carries a thread-guiding needle 5. For moving the plies of a workpiece to be joined together, the sewing machine has a lower feed dog 6 and an upper feed dog 7.

The feed dog 6 is received by a feed dog holder 8 which is disposed below the bed plate of housing 1 and whose forked end embraces a sliding block 9. The latter is in one piece with a journal 10 and mounted to pivot in a rocker 12 secured on a shaft 11. The shaft 11, mounted below the bed plate, imparts to the feed dog 6 a lift movement in each stitch forming process. The other end of the feed dog holder 8 embraces a journal 13, which forms part of a rocker 14 which is forked and has arms 14*a*. Rocker 14 is secured on a shaft 15 also mounted below the bed plate. Shaft 15 imparts to the feed dog 6 a feed movement in each stitch forming process.

The sewing machine is provided with a transverse feed mechanism 16. The transverse feed mechanism 16 generates movement of the lower feed dog 6 in the transverse feed direction and also generates the movement of the upper feed dog 7 in the transverse feed direction. The transverse feed mechanism 16 includes setting devices 17 and 18 to provide an adjustment for the movements in the transverse feed direction. The transverse feed mechanism 16 is connected to the upper feed dog 6 by means of the setting device 17. The transverse feed mechanism 16 is connected to the upper feed dog 7 by means of the setting device 18.

Figure 2:
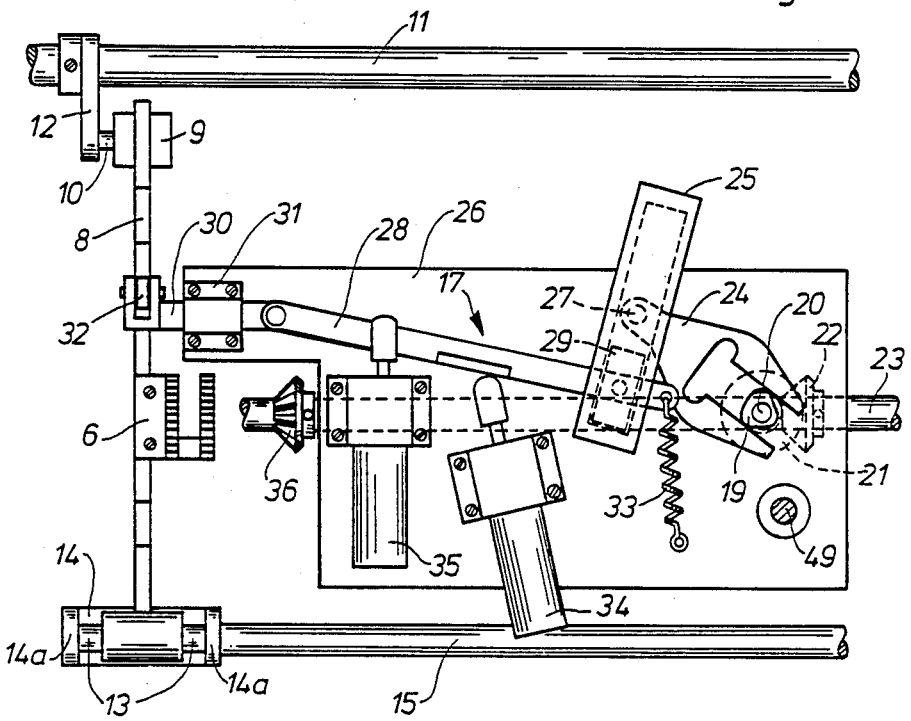
FIG. 2 is a sectional view taken along line II-II of FIG. 1.

The setting device 17 shown in FIG. 1 and 2 is driven by an eccentric 19 which is arranged non-rotationally on a shaft 20 mounted vertically in housing 1. To drive the shaft 10 there is secured on the latter a bevel gear 21 which is in engagement with a bevel gear 22. Bevel gear 22 is secured on a revolving shaft 23 mounted parallel to shafts 11 and 15 in housing 1. Engaging at the eccentric 19 is an eccentric fork 24 which is in one piece with a slide 25. The eccentric fork 24 and the slide 25 are mounted to pivot about a journal 27 received in a bearing block 26 of housing 1. At a coupling rod 28 a sliding block 29 is articulated, which is guided in slide 25. The other end of coupling rod 28 is articulated to a connecting rod 30 which is displaceably received in a straight-line guide 31. The connecting rod 30 has a forked end extending at an angle and embraces a joint 32 of the feed dog holder 8.

Coupling rod 28 is connected to one end of an extension spring 33, the other end of which is hooked to the bearing block 26. Connected to the bearing block 26 also are two pressure medium-operated cylinders 34 and 35 engaging at the coupling rod 28.

Figure 3:
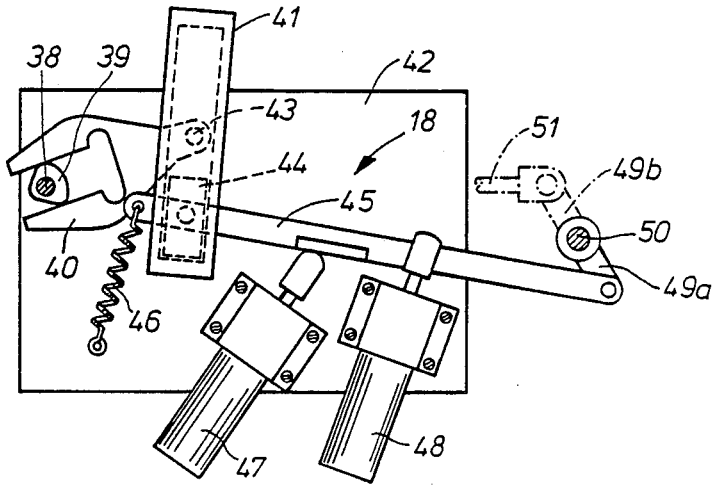
FIG. 3 is a sectional view taken along line III-III of FIG. 1.

The setting device 18 shown in FIG. 1 and 3 is driven and adjusted in the same manner as the setting device 17. The drive is taken off from shaft 23 via bevel gears 36, 37 and transmitted to a vertical shaft 38, on which an eccentric 39 is secured. The latter is engaged by an eccentric fork 40 which is in one piece with a slide 41 and pivots about a journal 43 received by a bearing block 42 of housing 1. In the slide 41 slides a sliding block 44 which is held at a coupling rod 45 on which there engage also an extension spring 46 and two cylinders 47 and 48 as setting elements.

Articulated with the other end of the coupling rod 45 is a rocker 49*a* which, referring to FIG. 1, is secured to the lower end of a vertical oscillating shaft 50. This shaft 50 is rotatably mounted in the bearing block 42. At the upper end of the oscillating shaft 50 a rocker 49*b* is secured. Rocker 49*b* has the same length as rocker 49*a* and is disposed rotated 180°in relation thereto. Rocker 49*b* engages articulatedly at a coupling rod 51, the opposite end of which is connected with an angular connecting rod 53 through a joint 52. At its other end, the connecting rod is connected to the upper feed dog 7, which is mounted for transverse movement. The upper feed dog 7 is received in a cutout of the presser foot 2. The width of this cutout depends on the maximum possible transverse feed movement of the upper feed dog 7.

The cylinders 34, 35 and the cylinders 47, 48 are designed as double action cylinders and can be actuated through a common control unit 54 (FIG. 5). To this end, the cylinders 34, 35, 47, 48 are connected via two feed lines for each with a 4/3-way valve 55 to 58 in each instance. The 4/3-way valves 55 to 58 are connected via a common pressure medium line 59 to a pressure source 60.

The 4/3-way valves 55 to 58 are actuated by electromagnets 61*a* to 61*h* which are addressed by electric pulses delivered by the control unit 54. The pulses are transmitted by electric lines.

The longitudinal feed mechanism of the first embodiment example is set up as follows: On shaft 23 (FIG. 1)

two eccentrics 62, 63 are arranged non-rotationally. An eccentric rod 64 embracing eccentric 62 is articulated at its opposite end to a rocker 65 secured on shaft 11. A second eccentric rod 66 embracing eccentric 63 is articulated to a journal 67 on which a pitman 68 is mounted, which is connected by means of a journal 69 with a crank 70 secured on shaft 15. Laterally of the eccentric rod 66, a journal 67, a pitman 71 is secured which embraces a journal 73 carried by a crank 72. The effective length of pitman 68 equals the effective length of pitman 71, so that, when the two journals 69 and 73 are in alignment, shaft 15 remains at rest despite the moving eccentric rod 66.

For varying the movement of eccentric rod 66 acting on shaft 15, crank 72 is clamped on a setting shaft 74. The setting shaft 74 carries a crank 75 which is connected via a tie rod 76 to one end of a rocking lever 77. Rocking lever 77 is secured on a shaft 78 mounted in housing 1. The other end of rocking lever 77 has a spherical projection 79 which protrudes between lateral walls of a setting groove 80 of a setting wheel 81 rotatably arranged on an axle 82 fixed to the housing. By turning the setting wheel 81, the feed of the feed dog 6 and hence the stitch length is adjusted in known manner.

Engaging at crank 75 is a tension spring 83, which is hooked by its other end to the housing 1 and which causes the projection 79 of rocking lever 77 protruding into the setting groove 80 to apply against the outer of the lateral walls of the setting groove 80 and causes the feed dog 6 to execute a feed movement in forward direction. For reversal of the feed direction, there is secured on the end of shaft 78 protruding from housing 1 a switching lever 84 by which the rocking lever 77 can be made to apply against the inner lateral wall of the setting groove 80.

In the above-described manner also the magnitude and direction of the longitudinal feed movement of the upper feed dog 7 is adjustable at the same time. To this end, a pitman 85 engages at crank 75, the opposite end of which is connected with a rocker 86. Rocker 86 is secured on a setting shaft 87 mounted in housing 1. Setting shaft 87 carries a yoke 88, between the arms 88*a* of which an additional yoke 89 is mounted to pivot about journal 90. The arms 89*a* of yoke 89 are connected together by the journal 91.

Mounted in the head of housing 1 are a revolving drive shaft 92 and a rocking arm 93 disposed parallel thereto. On drive shaft 92 an eccentric 94 is received non-rotationally, the eccentric 95 of which embraces the journal 91 and imparts to yoke 89 oscillating movements about the journal 90. On journal 91 is arranged further a pitman 96 which by means of a journal 97 is articulated to a rocker 98 fastened to one end of the rocking shaft 93. At the other end of drive shaft 92 or respectively of rocking shaft 93 there engages a lever mechanism 99 described more specifically in the following, by which the upper feed dog 7 and the presser foot 2 are actuated.

A drive crank 100 in one piece with the drive shaft 92 is provided with a journal 101 on which an intermediate piece 102 is pivotably received. The intermediate piece 102 drives an eccentric 103 which is secured on a journal in the head of housing 1 and which is embraced by one end of an eccentric rod 104. The other end of the eccentric rod 104 is articulated to an angle lever 105 which is mounted to pivot on a journal 106 fixed on the housing. The other end of the angle lever 105 is connected via an intermediate element 107 with a lever 108 (FIG. 4), the free end of which engages from below a roller 109 by two lateral bearing webs of the upper feed dog 7. The axle (not shown) of the roller is rotatably mounted in the bearing webs. Lever 108 imparts the necessary lift movement to the upper feed dog 7.

At what in FIG. 1 is the left end of rocking shaft 93, a rocker 110 engages, the other end of which is articulated to a rocker 112 via an intermediate piece 111. Rocker 112 is secured on a rocking shaft 113. At the opposite end of rocking shaft 113 a fork 114 is articulated, the forked ends 114*a* of which pivotably embrace a journal 116 received on a shank 115. Shank 115 is continuously pressed downward by a ball 117 which is provided between the shank and the presser foot bar 3 and is spring-loaded via the presser foot bar 3. At the lower end of presser bar 3 a support 118 is arranged, at which a journal 119 is received. At this journal 119, on both sides of support 118, a pitman 120 for each is articulated. The other ends of the pitman 120 embrace a journal 121 arranged on shank 115. The elements 110 to 121 serve to drive and guide the upper feed dog 7 in longitudinal feed direction.

For driving the upper feed dog 7 in transverse feed direction, the connecting rod 53 is connected with shank 115 (FIG. 4). To mount shank 115 for transverse movement, the distance between the ends 114*a* of fork 114 or respectively between the two pitmans 120 is greater than the width of shank 115, so that the latter is displaceable in transverse feed direction on the journals 116 and 121.

The mode of operation of the sewing machine of the first embodiment example is as follows:

The driven shaft 92 and shaft 23 are coupled together and revolve at the ratio 1:1. The movement of shaft 23 is transmitted from the bevel gears 22 and 36 to the bevel gears 21 and 37. As all bevel gears have the same dimensions, the shafts 20 and 38 and the eccentrics 19 and 39 received thereon run synchronously with shaft 23. Owing to this, the transverse feed mechanism 16 is driven in timed relationship with the stitch forming process of the sewing machine.

By the rotation of eccentric 19, the eccentric fork 24 of the setting device 17 together with the slide 25 is pivoted about the journal 27, owing to which the sliding block 29 imparts a combined sliding and pivoting movement to the coupling rod 28. Due to its suspension in the straight-line guide 31, the connecting rod 30 connected with the coupling rod 28 can carry out — of the movements transmitted to it — only a movement crosswise to the longitudinal feed direction of the feed dog 6.

The sliding block 9 and the journal 13 received by the arms 14*a* of rocker 14 are wider than the ends of feed dog holder 8, so that the latter is mounted movable in transverse feed direction. The connecting rod 30 connected via joint 32 with the feed dog holder 8 transmits to the latter the transverse feed movement, the amount and direction of which are determined by the setting of the setting device 17 described above.

The setting is done through the cylinders 34, 35. By the extension spring 33 the coupling rod 28 is continuously brought to abutment on the piston rods of the cylinders 34, 35. When both pistons are extended into the cylinders 34, 35, the sliding block 29 is in one of its two extreme positions with maximum distance from the journal 27. Thereupon the feed dog 6 executes, starting from its zero position in transverse feed direction, a transverse feed movement to the left per FIG. 1 and 2 which is maximum as to amount. When the piston of cylinder 34 is completely extracted while the piston of cylinder 35 is still in, then the sliding block 29 is disposed in the axis of rotation of the eccentric fork 24. The movements of the feed dog 6 in transverse feed direction are then negligibly small. When the piston of cylinder 35 is extracted also, the sliding block 29 is pushed into its other extreme position with maximum distance from the axis of rotation of the eccentric fork 24, so that the feed dog 6 executes, starting from the zero position, maximum transverse feed movements to the right per FIG. 1 and 2.

When using hydraulic cylinders, their pistons can be stopped in any number of positions between the above-mentioned extreme positions, owing to which the amount of the transverse feed movements executed by the feed dog 6 is adjustable continuously.

The setting device 18 is driven and adjustable in the same manner as the setting device 17. The eccentric fork 40 moved by the rotating eccentric 39 as well as the slide 41 are pivoted about the journal 43, whereby the sliding block 44 is taken along. The movements of the sliding block 44 are relayed via the coupling rod 45 and transmitted to the rocker 49*a*. Due to the identical dimensions and the common axis of rotation, the movements of the two rockers 49*a* and 49*b*, offset by 180°, are, for small pivot movements in transverse feed direction, the same as to amount but opposite as to direction, so that the direction of the movement transmitted from coupling rod 45 to coupling rod 51 is reversed. Coupling rod 51 transmits this transverse feed movement to the tie rod 53 connected with shank 115 of the upper feed dog 7.

As shank 115 is mounted for transverse movement, it is moved by the transverse feed mechanism 16 in transverse feed direction relative to the lever mechanism 99. The amount and direction of the transverse feed movement to be carried out are adjustable by the cylinders 47,48, in that they displace the coupling rod 45, thereby changing the position of the sliding block 44 in slide 41 relative to the axis of rotation of the eccentric fork 40.

The cylinders 34, 35 and 47, 48 are actuated by the control unit 54. It can be operated for example by the operator through switches or by a sensor system using the workpiece edge.

The control unit 54 can actuate each of the cylinders 34, 35, 47, 48 singly, in that it delivers an electric pulse to one of the electromagnets 61*a* to 61*h*, for example to electromagnet 61*a*. Thereupon the latter pushes the 4/3-way valve 55 from its stopping position shown in FIG. 5 to the right, so that the pressure medium, for example oil, conveyed from the pressure source 60 via the pressure medium line 59 gets via the left feed line into cylinder 34. The piston of cylinder 34 is thereby extracted. If the pressure medium is oil, the piston can be stopped in any position between its two extreme positions (moved out or in) if the electromagnet 61*b* is controlled so that it pushes the 4/3-way valve into its stopping position again. If, however, the electromagnet is controlled so that it pushes the 4/3-way valve all the way to the left, the oil gets into the right-hand feed line and the piston moves into the cylinder.

In the manner described also the other cylinder 35, 47 and 48 are controlled and actuated. Thus, the position of the pistons of cylinders 34, 35, moved in or out, can correspond to that of pistons of the cylinders 47, 48 so that the amount and direction of the transverse feed movement of the feed dog 6 and upper feed dog 7 are the same and the individual plies of a workpiece are moved synchronously in transverse feed direction. On the other hand, if the piston position of the cylinders 34, 35 is different from that of the cylinders 47, 48, the plies are displaced with a desired relative motion.

As the transverse feed movement generated by the transverse feed mechanism 16 can have the longitudinal feed movement superimposed on it by geometric addition of at least two motion components in any desired manner, there results any desired number of transport directions for the workpiece to be moved.

Figure 6:
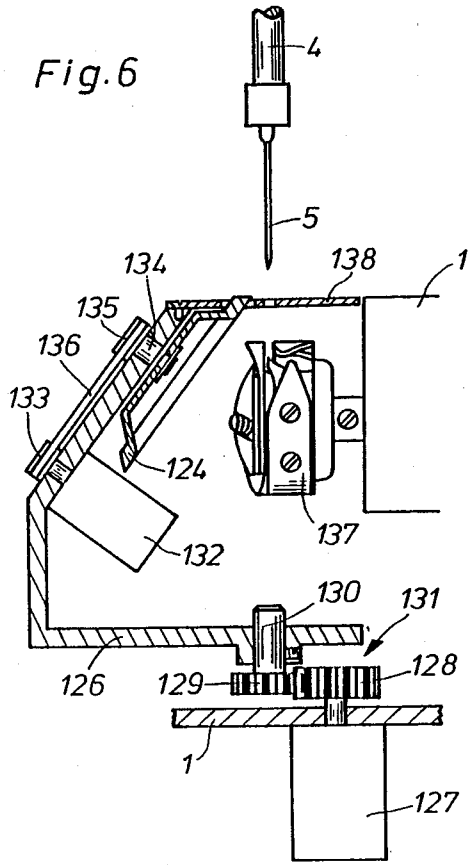
FIG. 6 is a side view of the lower feed device of a second embodiment of the invention, partially in section.

In the second embodiment example shown in FIGS. 6 to 9, the lower feed device has a feed wheel 124 and the upper feed device a roller presser 125. Below the bed plate of the sewing machine a support 126 is pivotably mounted, the pivot axis of which coincides with the axis of the needle bar 4 (FIG. 6). The pivotal motion is generated by a drive motor 127 and is transmitted from a spur gear 128 fixed to the shaft thereof to a spur gear 129 which is secured on a shaft 130 received nonrotationally in the support 126. The parts 127 and 128 form a pivoting mechanism 131 for the feed wheel 124.

Secured to the support 126 is a drive motor 132, to the shaft of which a belt pulley 133 is fixed. On a shaft 134 mounted in the support 126 there is secured at one end a guide roller 135 and at the other end the feed wheel 124. A belt 136 is passed over the belt pulley 133 and over the guide roller 135. The feed wheel 124 is arranged inclined toward a loop taker 137 mounted in housing 1; it is designed as a ring and projects over a stitch plate 138 connected with the support 126.

Figure 8:
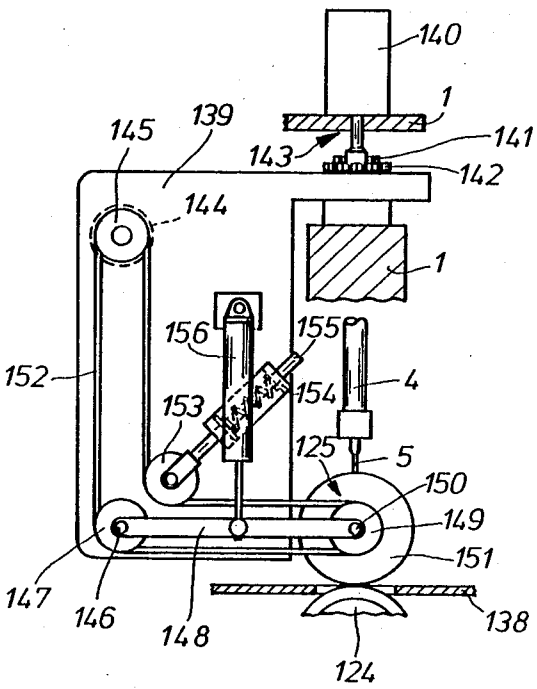
FIG. 8 is a side view of the feed device shown in FIG. 7, partially in section
Figure 7:
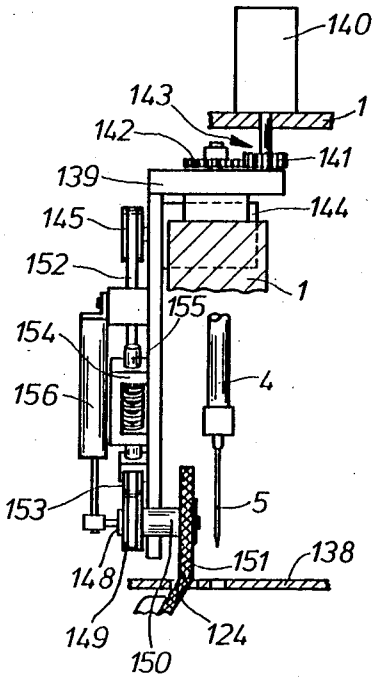
FIG. 7 is a front view of the upper feed device for the second embodiment of the invention, partially in section.
Figure 9:
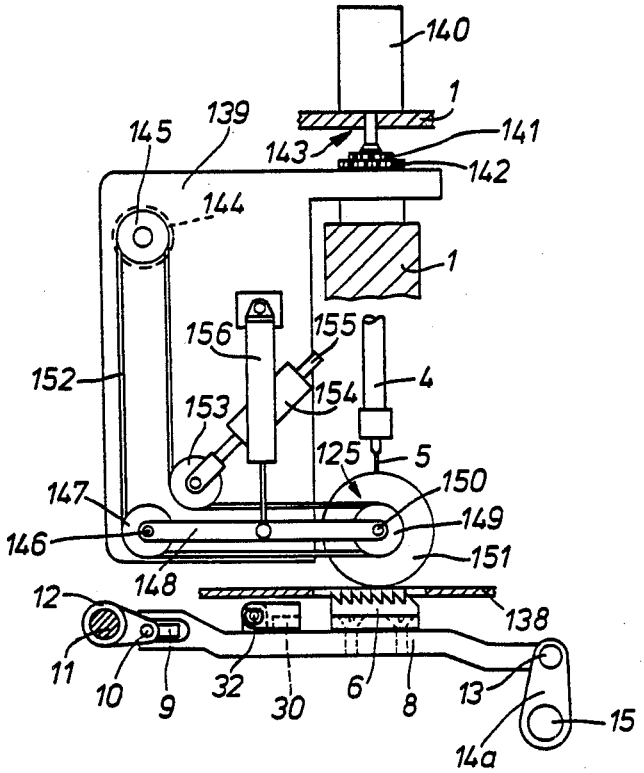
FIG. 9 is a side view of the upper and lower feed device of a third embodiment of the invention, partially in section.

In the head of housing 1 a support 139 is pivotably mounted, whose axis of rotation coincides with the axis of the needle bar 4 (FIGS. 7 to 9). The pivoting motion is transmitted by a drive motor 140 also arranged at the housing 1 via a spur gear 141 secured thereon to a spur gear 142 non-rotationally connected with the support 139. The parts 140 and 141 form a swivel mechanism 143.

On the support 139 a drive motor 144 is applied. A shaft protruding from the housing of this drive motor serves to receive a belt pulley 145 which is firmly connected with the shaft. In the support 139 a journal 146 is received, on which are pivotably mounted a guide roller 147 and a lever 148. At the opposite end of lever 148, an additional guide roller 149 is received on a shaft 150 and non-rotationally connected therewith. In addition, an upper feed roller 151 is secured on shaft 150. This feed roller together with the lever 148 engaging thereon forms the roller presser 125.

A belt 152 is passed over pulley 145 as well as over the guide rollers 147 and 149. This belt is tensioned by a roller 153 at which there engages a spring-loaded bar 155 displaceably mounted in a bearing yoke 154 connected with the support 139. On the support 139 is pivotably secured a pressure medium operated cylinder 156, the piston rod of which is connected with lever 148.

The sewing machine of the second embodiment example operates as follows:

The drive motors 127, 132, 140 and 144 are bidirectional and are connected via electric lines to a common control unit now shown. They can be actuated by the latter singly or in combination. As soon as drive motor 127, for example, is actuated, it drives the support 126 via the spur gears 128, 129, so that the support together with the feed wheel 124 mounted therein is pivoted about its axis of rotation. To be able to make the slot in the stitch plate for the passage of the feed wheel 124 as small as possible, the stitch plate is connected with the support 126 and is taken along during the movement thereof. For this reason the stitch plate 138 embedded in the bed plate of the sewing machine is of circular design.

The feed wheel 124 is drivable by the drive motor 132 via the belt 136. Since the feed wheel 124 is bidirectional about the axis of shaft 134 (may rotate in both directions about shaft 134), as is the support 126 bidirectional about the axis of shaft 130 (may swivel in both directions about shaft 130), a swivel range of the support 126 of 90° is sufficient for moving a workpiece disposed on the stitch plate 138 in all feed directions.

Due to the design of the feed wheel 124 and due to its arrangement relative to the loop taker 137, the feed wheel oscillates about the loop taker 137 in an angle of 90° and is arranged sufficiently close to the stitch formation point without being hindered by the loop taker 137.

The drive motor 140 drives the support 139 by way of the spur gear 141,142. In addition, the upper feed roller 151 of the roller presser 125 is driven by the drive motor 144 via belt 152. Also for the roller presser 125 it is true that it needs to have a swivel range of only 90°, because the drive motors 140,144 are bidirectional.

Cylinder 156 serves to lift the roller presser 125 off a workpiece disposed on the stitch plate 138 by a swivel motion about journal 146. Thereby the compression of the workpiece, formed by the plier type grip of the feed wheel 124 and roller presser 125, is abolished, whereupon the feed wheel 124 and the roller presser 125 can be pivoted without taking the workpiece along.

If the workpiece has several plies, they are displaceable without a relative motion if the feed wheel 124 and the upper feed roller 151 are driven at equal circumferential speed. However, the plies are movable relative to each other also if the circumferential speed of the feed wheel 124 and of the upper feed roller 151 differ.

In a third embodiment example (see FIG. 9), the sewing machine is designed with the previously described feed dog 6 as lower and the likewise described roller presser 125 as upper feed device. In this arrangement the feed dog 6 executes a combined feed and transverse feed movement for the transport of a workpiece, while the roller 125 is rotated into the required feed direction, displacing the workpiece in this feed direction.

While specific embodiments of the invention have been shown and described in detail to illustrate the application of the principles of the invention, it will be understood that the invention may be embodied otherwise without departing from such principles.

What is claimed is:

1. A sewing machine comprising: an upper workpiece feed device including an upper feed dog; a lower workpiece feed device including a lower feed dog; an upper feed drive connected to said upper feed dog including a longitudinal feed mechanism driving said upper feed dog in a longitudinal direction and an upper transverse feed mechanism for driving said upper feed dog in a transverse direction; a lower feed drive connected to said lower feed dog including a lower longitudinal feed mechanism for driving said lower feed dog in a longitudinal direction and a lower transverse feed mechanism for driving said lower feed dog in a transverse direction; and, a control means, said control means including a first setting device connected to said lower transverse feed mechanism and a second setting device connected to said upper transverse feed mechanism, said first setting device varying the feed direction of said lower feed device by setting the amount of feed of the lower feed dog in the transverse direction and said second setting independently controllable from said first setting device for device varying the feed direction of said upper feed device by setting the amount of feed of the upper feed dog in the transverse direction.

2. A sewing machine according to claim 1 wherein: said first and second setting means include cylinders.

3. A sewing machine according to claim 2, wherein: the lower feed dog and the upper feed dog are each moveable by one of the first and second setting means respectively, from a maximum position to a minimum position, and by the other setting means from a minimum position to a maximum position.

4. A sewing machine according to claim 1, wherein said control means includes: a first setting means connected to said first setting device and a second setting means connected to said setting device for independently actuating said second setting device.

5. A sewing machine comprising: an upper driven roller presser for moving a workpiece in a feed direction; a lower driven feed wheel for moving a workpiece in a feed direction; said feed wheel and said roller presser each being mounted so as to pivot about a common vertical axis and each of said feed wheel and said roller presser being connected with a swivel mechanism; and, control means for varying the feed direction of each of the upper driven feed wheel and the lower driven roller presser.

6. A sewing machine comprising: an upper feed device including a driven roller presser; a lower feed device including a feed dog; and, control means for varying the feed direction of each of the upper feed device and lower feed device, said control means including a setting device connected with said feed dog for actuating said feed dog in a transverse feed movement, and said roller presser being coupled to a swivel mechanism, said swivel mechanism being mounted to pivot about a vertical axis.

* * * * *